United States Patent [19]

Peters

[11] Patent Number: 4,815,977

[45] Date of Patent: Mar. 28, 1989

[54] BREAST-FEEDING TRAINER

[76] Inventor: Sheila N. Peters, 1765 E. Lakewood, Springfield, Mo. 65807

[21] Appl. No.: 151,225

[22] Filed: Feb. 1, 1988

[51] Int. Cl.[4] ..... G09B 23/30

[52] U.S. Cl. ..... 434/267; 623/7

[58] Field of Search ..... 434/262, 267, 272, 273; 623/7

[56] References Cited

U.S. PATENT DOCUMENTS

| | | | |
|---|---|---|---|
| 3,099,839 | 8/1963 | Kester | 623/7 |
| 4,001,951 | 1/1977 | Fasse | 434/267 |
| 4,134,218 | 1/1979 | Adams et al. | 434/267 |
| 4,439,162 | 3/1984 | Blaine | 434/268 |
| 4,531,919 | 7/1985 | Ware | 434/262 |
| 4,575,351 | 3/1986 | Gonzalez | 446/371 |
| 4,655,716 | 4/1987 | Hoevel | 434/267 |

*Primary Examiner*—William H. Grieb

*Attorney, Agent, or Firm*—Hovey, Williams, Timmons & Collins

[57] ABSTRACT

A breast-feeding trainer is provided to be worn over clothing in the teaching of nursing techniques. The trainer includes a simulated breast and is worn on the chest of a student in overlying relationship to the natural breasts. The trainer is constructed of lightweight material to be comfortably worn and easily removed after the completion of training. A shroud is draped over the simulated breasts to simulate clothing that may be manipulated during actual breast-feeding.

5 Claims, 1 Drawing Sheet

BREAST-FEEDING TRAINER

FIELD OF THE INVENTION

This invention relates to an article to be worn by women over conventional clothing and to be used to train in breast-feeding techniques. The article is lightweight and comfortable to wear, and presents a simulated, human female breast useful in the training of breast-feeding to new or prospective mothers. The trainer is advantageously provided with a cloth shroud which overlies the simulated breast to simulate the clothing which would be worn during nursing and thereby assist the student in learning the breast-feeding techniques useful in public situations.

BACKGROUND OF THE INVENTION

Breast-feeding, like childbirth, is a unique and natural function of motherhood which started with the roots of human existence. As our society became more "sophisticated", breast-feeding declined somewhat in popularity in favor of bottle feeding as a more convenient means of feeding babies. However, the nutritional and emotional advantages of breast-feeding have been publicly recognized and breast-feeding has thus enjoyed a resurgence in popularity.

Unfortunately, modern society is mobile and many prospective mothers are no longer able to learn first-hand from their own mothers the techniques of breast-feeding. At the same time, many prospective mothers and fathers are attending classes to learn about the process of childbirth and the techniques of not only delivery but caring for newborn infants. It is thus natural for prospective mothers to desire to learn about the proper techniques for breast-feeding during these instructional sessions.

Because the classes are often presented to both prospective mothers and fathers in a group setting, it is undesirable to teach breast-feeding using the female students' own breasts. This would often subject the modest student to unnecessary embarassment. Any training device should be lightweight and comfortable because many female attendees are several months pregnant and thus subjected to back strain which is attendant the weight gain of pregnancy.

It is thus desirable to provide a breast-feeding trainer which may be worn over everyday clothing, is lightweight, and is an anatomically correct simulation of a breast of the mother of a newborn in order to provide maximum instructional benefit to the student. In addition, the trainer is preferably constructed of materials which may be easily washed. Finally, the trainer is preferably constructed as a unit to avoid the necessity of reconstructing the trainer for each use.

SUMMARY OF THE INVENTION

The trainer in accordance with the present invention satisfies these requirements by providing a lightweight, anatomically correct simulated human female breast which may be worn on the outside of everyday clothing. The trainer is advantageously provided with a shroud which may obscure the simulated breast from view and simulates the clothing which would ordinarily be worn by a nursing mother. Further, the trainer is constructed as a single unit of materials that may be easily washed.

In the preferred form, the trainer is provided with a pair of simulated human female breasts which are adapted to be supported on the chest of a wearer in the same position as natural breasts. The pair of breasts are constructed as a unit and held in place by a pair of straps which may be tied behind the wearer's head, permitting the lightweight trainer to rest comfortably on the chest.

DESCRIPTION OF THE PREFERRED EMBODIMENT

Figure 1:
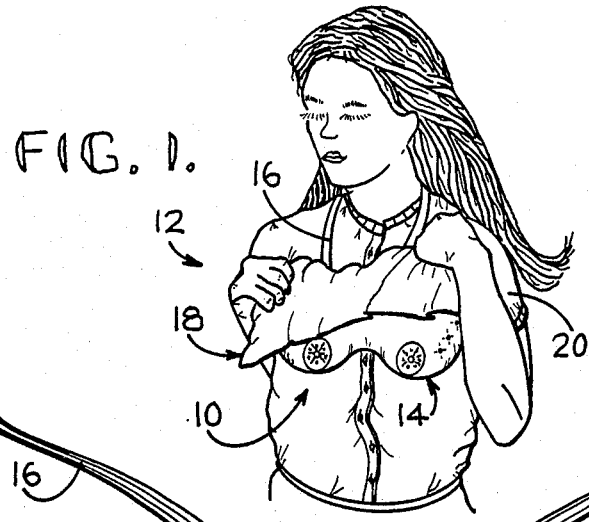
FIG. 1 is a perspective view showing the breast-feeding trainer in place on the chest of a wearer.

Referring now to the drawings, a breast-feeding trainer 10 is shown in FIG. 1 worn on the chest of a wearer 12. The trainer 10 broadly includes a pair of simulated breasts 14, a pair of straps 16 supporting the simulated breasts 14 and a shroud 18. The trainer 10 is normally worn on the outside of the clothing 20 of the wearer 12.

Figure 2:
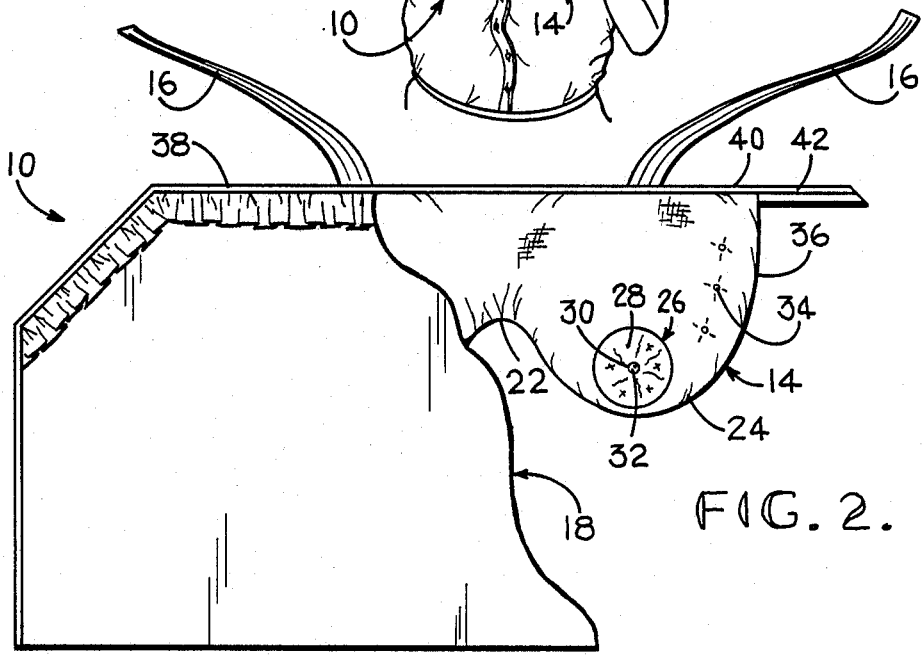
FIG. 2 is a fragmentary front elevational view of the breast-feeding trainer with a portion of the shroud removed to show the appearance of a simulated breast.

As shown in greater detail in FIG. 2, the simulated breasts 14 are of a unitary construction with the breasts 14 joined together in a cleavage area 22. The simulated breasts 14 are formed around inserts of synthetic bunting, foam rubber, or other suitable lightweight resilient material. The inserts are enveloped by material 24 colored in suitable flesh tones to present a natural appearance. The material 24 is a flexible material to permit the simulated breasts 14 to be manipulated easily. The simulated breasts 14 thus each present a shape approximately that of a human female breast and when joined together present the appearance of a "B" on its side.

In order for the trainer 10 to be effective, the simulated breasts 14 are detailed to be anatomically correct. That is, each breast 14 is provided with a simulated areola 26 which has Montgomery glands 28, a nipple 30 and nipple pores 32 simulated thereon. These details are provided by attaching the areola 26 to the breast 14 and gathering the material 24 to form a nipple 30, attaching Montgomery glands 28 and making perforations to form the nipple pores 32. In addition, plugged milk ducts 34 may be shown by attaching small portions of higher density material to the inside of the material 24. The breasts 14 are thus lightweight, compressable, anatomically correct, and constructed as a unit of washable material for ease of use.

Figure 3:
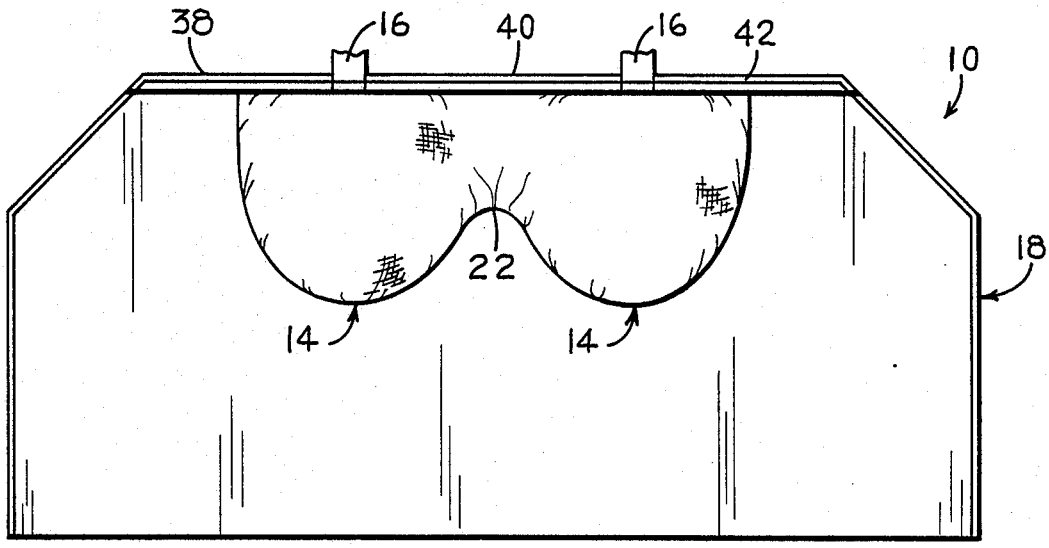
FIG. 3 is a fragmentary rear elevational view of the breast-feeding trainer with a portion of the straps cut away.

Overlying the breasts 14 is a retractable cloth shroud 18. The shroud 18 extends both below and beyond the sides 36 of the breasts 14 in overlapping relationship. The shroud 18 is preferably of lightweight, opaque material such as is ordinarily found in women's clothing. The shroud 18 is attached at its upper margin 38 to the top 40 of the breasts 14. A reinforcement or beading 42 is sewn into the top 40 o the simulated breasts in order to permit the shroud to properly drape. As shown in FIGS. 2 and 3, a pair of straps 16 are sewn into the upper margin 38 and beading 42 to permit the trainer 10 to be worn in the manner of an apron with the straps tied behind the wearer's neck and to hang therefrom.

In use, the wearer 12 ties the straps 16 at such a length that the breasts 14 of the trainer 10 overlie the student's own natural breasts over her clothing 20. An instructor would then demonstrate the appropriate nursing technique using a doll to simulate a newborn infant. The student wearer 12 could thus practice in a classroom setting the nursing technique taught and use the shroud 18 to become comfortable with the manipulation of clothing during nursing. For example, the shroud 18 would be draped over the breasts 14 and lifted or retracted when practicing breast-feeding. The doll would then be raised to the nipple 30 and the student wearer 12 would be shown how to hold the infant for best results. In addition, the trainer 10 may be used to demonstrate problems encountered in breast-feeding such as an inverted nipple 30 or clogged milk pores 34. The trainer 10 may be comfortably worn and easily removed after the training session.

It will be appreciated that the breast feeding trainer hereinabove described may be worn by a teacher before a class of others so that the teacher may impart to the others the appropriate breast-feeding techniques, by way of demonstation using the trainer. The students may also wear a trainer during the teaching session so that the proper breast-feeding techniques may be practiced utilizing the trainer while it is on the body of the student and the information is fresh in the minds of the students.

Yet further, the breast feeding trainer may be used to demonstrate the use of breast shields, pumps, pads and brassieres to students and may be used to demonstrate proper nipple preparation and breast anatomy. If desired, the trainer may be used, either by teacher or student, with a doll to demonstrate or to learn nursing positions while holding a baby. Either one or both breasts of the trainer may be used, the left breast being shown in detail in FIG. 2 of the drawing.

I claim:

1. A breast-feeding trainer comprising a lightweight simulated human female breast having a simulated human nipple, and support means for positioning the simulated breast on the chest of a human wearer, said nipple being oriented for access thereto during breast-feeding training without removal of said support means by the human wearer.

2. A breast-feeding trainer in accordance with claim 1, further comprising a flexible shroud attached to and overlying said simulated breast, said shroud capable of being retracted.

3. A breast-feeding trainer in accordance with claim 1, further comprising a pair of lightweight simulated human female breasts.

4. A breast-feeding trainer in accordance with claim 1, wherein said support means includes a pair of straps enabling the trainer to hang from the wearer's neck.

5. A breast-feeding trainer in accordance with claim 2, wherein a reinforcement is attached to the top of the simulated breast.

* * * * *